US007432475B2

(12) United States Patent
Nakajima et al.

(10) Patent No.: US 7,432,475 B2
(45) Date of Patent: Oct. 7, 2008

(54) VERTICAL HEAT TREATMENT DEVICE AND METHOD CONTROLLING THE SAME

(75) Inventors: Makoto Nakajima, Minami-alps (JP); Takanori Saito, Kai (JP); Tsuyoshi Takizawa, Hokota (JP); Manabu Honma, Kai (JP)

(73) Assignee: Tokyo Electron Limited, Tokyo (JP)

( * ) Notice: Subject to any disclaimer, the term of this patent is extended or adjusted under 35 U.S.C. 154(b) by 152 days.

(21) Appl. No.: 10/584,258

(22) PCT Filed: Dec. 22, 2004

(86) PCT No.: PCT/JP2004/019251

§ 371 (c)(1),
(2), (4) Date: Jun. 26, 2006

(87) PCT Pub. No.: WO2005/064254

PCT Pub. Date: Jul. 14, 2005

(65) Prior Publication Data

US 2007/0148606 A1 Jun. 28, 2007

(30) Foreign Application Priority Data

Dec. 26, 2003 (JP) ..... 2003-432596

(51) Int. Cl.
*F27B 5/14* (2006.01)

(52) U.S. Cl. ..... 219/390; 219/405; 219/411; 392/416; 392/418; 118/724; 118/725; 118/50.1

(58) Field of Classification Search ..... 219/390, 219/405, 411; 392/416, 418; 118/724–730, 118/50.1

See application file for complete search history.

(56) References Cited

U.S. PATENT DOCUMENTS 6,403,927 B1 * 6/2002 Kato ..... 219/390

FOREIGN PATENT DOCUMENTS

JP 3-79985 4/1991

* cited by examiner

*Primary Examiner*—Shawntina Fuqua
(74) *Attorney, Agent, or Firm*—Oblon, Spivak, McClelland, Maier & Neustadt, P.C.

(57) ABSTRACT

A vertical heat processing apparatus includes a process chamber (5) defining a process field (A1) configured to accommodate a plurality of target substrates (W) supported at intervals in a vertical direction. The apparatus further includes a heating furnace (8) surrounding the process chamber (5) and including an electric heater (15), and an electric blower (16) configured to send a cooling gas into the heating furnace (8). A control section (22) executes, in order to converge the process field (A1) to a target temperature, performing power feeding to the heater (15) to heat up the process field (A1) to a predetermined temperature immediately below the target temperature, and at a time point when the process field (A1) reaches the predetermined temperature, decreasing the power feeding to the heater (15), and supplying the cooling gas from the blower (16) to forcibly cool the process field (A1).

12 Claims, 4 Drawing Sheets

VERTICAL HEAT TREATMENT DEVICE AND METHOD CONTROLLING THE SAME

TECHNICAL FIELD

The present invention relates to a vertical heat processing apparatus and a control method for the same, and particularly to a semiconductor process technique.

The term "semiconductor process" used herein includes various kinds of processes which are performed to manufacture a semiconductor device or a structure having wiring layers, electrodes, and the like to be connected to a semiconductor device, on a target substrate, such as a semiconductor wafer or a glass substrate used for an LCD (Liquid Crystal Display) or FPD (Flat Panel Display), by forming semiconductor layers, insulating layers, and conductive layers in predetermined patterns on the target substrate.

BACKGROUND ART

In manufacturing semiconductor devices, various processing apparatuses are used to subject a target substrate, such as a semiconductor wafer, to processes, such as CVD (Chemical Vapor Deposition), oxidation, diffusion, reformation, annealing, and etching. As processing apparatuses of this kind, vertical heat processing apparatuses that subject a number of wafers together to a heat process are known. In general, vertical heat processing apparatuses have a vertical airtight process chamber for accommodating wafers. The process chamber has a load port formed at the bottom, which is selectively opened and closed by a lid moved up and down by an elevator. Within the process chamber, the wafers are supported at intervals in the vertical direction on a holder called a wafer boat. A heating furnace is disposed around the process chamber.

There are vertical heat processing apparatuses of the type that has a blower for sending air into a heating furnace to forcibly air-cool a process chamber (for example, see Jpn. Pat. Appln. KOKAI Publication No. 2002-305189). When a heat process is finished, the blower is used to rapidly cool the wafers and process chamber.

On the other hand, there are heat processes using a low temperature range of, e.g., 100 to 500° C., such as a heat process for forming a low dielectric constant film on wafers. In such heat processes using a low temperature range, it is important to quickly increase the temperature and converge it to a predetermined heat process temperature. In this respect, it has been proposed to use a metallic process chamber in place of a quartz process chamber for a heat processing apparatus using a low temperature, so as to improve the thermal response of the heat processing apparatus.

However, for heat processes that generate sticky deposits, quartz process chambers are preferably used, because they are easy to clean or replace.

However, quartz process chambers have a large thermal capacity, and thus prolong the convergence time in attaining a target temperature in temperature increase recovery within a low temperature range.

Accordingly, they affect shortening of the TAT (Turn Around Time) and improvement of the throughput.

DISCLOSURE OF INVENTION

An object of the present invention is to provide a vertical heat processing apparatus and a control method for the same, which can shorten the convergence time in attaining a target temperature in temperature increase recovery within a low temperature range, and thus can shorten the TAT and improve the throughput.

According to a first aspect of the present invention, there is provided a vertical heat processing apparatus comprising:

a process chamber defining a process field configured to accommodate a plurality of target substrates supported at intervals in a vertical direction;

a heating furnace surrounding the process chamber, and including an electric heater configured to heat the process field from outside the process chamber;

an electric blower configured to send a cooling gas into the heating furnace, so as to cool the process field by the cooling gas from outside the process chamber;

a temperature sensor configured to detect a temperature inside the process field; and a control section configured to control the heater and the blower in accordance with detection data obtained by the temperature sensor, wherein, when the control section conducts temperature control to change a temperature of the process field from an initial temperature to a target temperature higher than the initial temperature but within a range of 100 to 500° C., the control section executes, in order to converge the process field to the target temperature, performing power feeding to the heater at a first supply rate or more to heat up the process field to a predetermined temperature immediately below the target temperature, at a time point when the process field reaches the predetermined temperature, decreasing the power feeding to the heater to a rate lower than the first supply rate, and then, while setting the power feeding to the heater at a rate lower than the first supply rate, supplying the cooling gas from the blower to forcibly cool the process field.

According to a second aspect of the present invention, there is provided a method of controlling a vertical heat processing apparatus, the apparatus comprising a process chamber defining a process field configured to accommodate a plurality of target substrates supported at intervals in a vertical direction, a heating furnace surrounding the process chamber, and including an electric heater configured to heat the process field from outside the process chamber, and an electric blower configured to send a cooling gas into the heating furnace, so as to cool the process field by the cooling gas from outside the process chamber, and when the method conducts temperature control to change a temperature of the process field from an initial temperature to a target temperature higher than the initial temperature but within a range of 100 to 500° C., the method comprising, in order to converge the process field to the target temperature:

performing power feeding to the heater at a first supply rate or more to heat up the process field to a predetermined temperature immediately below the target temperature, at a time point when the process field reaches the predetermined temperature, decreasing the power feeding to the heater to a rate lower than the first supply rate, and then, while setting the power feeding to the heater at a rate lower than the first supply rate, supplying the cooling gas from the blower to forcibly cool the process field.

BEST MODE FOR CARRYING OUT THE INVENTION

Figure 1:
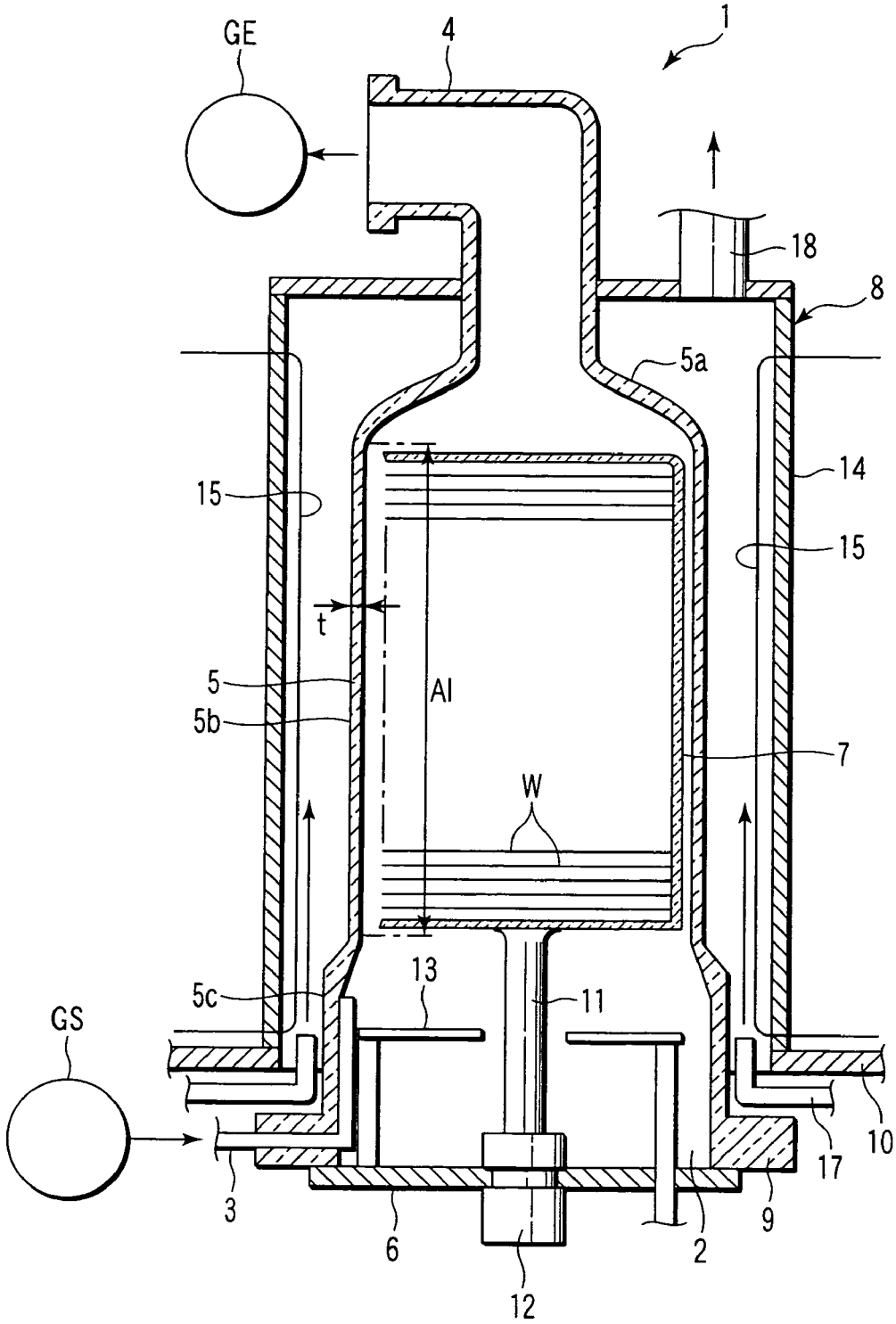
FIG. 1 is a sectional side view schematically showing a vertical heat processing apparatus according to an embodiment of the present invention.

Embodiments of the present invention will now be described with reference to the accompanying drawings. In the following description, the constituent elements having substantially the same function and arrangement are denoted by the same reference numerals, and a repetitive description will be made only when necessary.

FIG. 1 is a sectional side view schematically showing a vertical heat processing apparatus according to an embodiment of the present invention. As shown in FIG. 1, this vertical heat processing apparatus 1 includes a cylindrical and vertical process chamber 5 opened at the bottom. Further, the process chamber 5 is further provided with a flange 9 at the bottom, which is supported by a base plate 10 through a support member (not shown).

The process chamber 5 is integrally formed from quartz, which has high heat resistance. The process chamber 5 defines therein a process field A1 to accommodate a plurality of semiconductor wafers W stacked at intervals in the vertical direction. The process chamber 5 has a body portion 5*b* corresponding to the process field A1, which is thinner than an upper portion 5*a* and a lower portion 5*c* present above and below the body portion 5*b*, respectively. Specifically, body portion 5*b* has a wall thickness "t" of 2 to 6 mm, and preferable of 2 to 4 mm, and the difference in wall thickness between the body portion 5*b* and the upper and lower portions 5*a* and 5*c* is 4 mm or less. For example, the body portion 5*b* has a wall thickness "t" of about 4 mm, and the upper and lower portions 5*a* and 5*c* have a wall thickness of about 6 mm. This arrangement allows the thermal capacity of the body portion 5*b* to be smaller than that in the prior art, and thus allows the process field A1 to be rapidly heated or cooled.

An exhaust port 4 is formed at the top of the process chamber 5. The exhaust port 4 is connected to, e.g., an exhaust nozzle laterally bent at right angles. The exhaust nozzle is connected to an exhaust section GE including a pressure control valve and a vacuum pump. The interior of the process chamber 5 is vacuum-exhausted and set at a predetermined vacuum level by the exhaust section GE.

A plurality of gas nozzles 3 penetrate the flange 9 at the bottom of the process chamber 5 to supply gases into the process chamber 5. The gas nozzles 3 are connected to a gas supply section GS including gas sources of a process gas and an inactive gas (for example $N_2$ gas).

The process chamber 5 has a load port 2 formed at the bottom to be opened and closed by the lid 6. A wafer holder (wafer boat) is loaded and unloaded into and out of the process chamber 5 through the load port 2. The holder 7 is made of quartz, and functions as holding means for holding semiconductor wafers W at intervals in the vertical direction. In this embodiment, the holder 7 can support, e.g., 25 wafers W each having a diameter of 300 mm, essentially at regular intervals in the vertical direction.

The holder 7 has a leg portion 11 connected at the center of the bottom. The leg portion 11 is connected at its lower end to a rotating mechanism 12 disposed at the center of the lid 6. The rotating mechanism 12 is used to rotate the holder 7 during a process of wafers W. A planar heater 13 for the bottom side is disposed on the lid 6 to surround the leg portion 11 to prevent heat radiation through the load port 2.

The lid 6 is attached to the distal end of an arm (not shown) supported by an elevating mechanism (not shown), such as a boat elevator. The elevating mechanism is used to integratedly move the holder 7 and lid 6 between a position inside the process chamber 5 and a loading area (not shown) therebelow used as a work space. The loading area is provided with a transfer mechanism (not shown) disposed therein to transfer wafers W to and from the holder 7.

The process chamber 5 is surrounded and covered with a heating furnace 8 for heating the process chamber 5. The heating furnace 8 includes a cylindrical cover 14 and an electric heater 15 disposed therein. The cover 14 originally has openings at the top and bottom in accordance with the shape of the process chamber 5, but the openings are preferably essentially closed.

The heater 15 is formed of, e.g., resistance heating bodies, which expand in an annular direction along the inner surface of the cover 14. Thus, the heater 15 heats the process field A1 from outside the process chamber 5. The heater 15 comprises portions respectively disposed at the zones of the process field A1 divided in the vertical direction, so as to individually control heating of the respective zones. The heater 15 may be formed of a quartz pipe and a carbon wire inserted therein, for example.

The cover 14 is structured as a water-cooling jacket in which cooling water is circulated. Alternatively, the cover 14 may be formed of a cylindrical heat-insulating cover. However, in light of thermal response, a cover of the water-cooling jacket type is preferably used.

A blower (blower machine) 16 is connected to the heating furnace 8, to send a cooling gas, such as air, into the heating furnace 8. Thus, the cooling gas cools the process field A1 from outside the process chamber 5. A gas supply duct 17 from the blower 16 is connected to a lower portion of the heating furnace 8. An exhaust duct 18 for exhausting gas from the heating furnace 8 is connected to an upper portion of the heating furnace 8.

Gas in the heating furnace 8 can be exhausted from the exhaust duct 18 through a heat exchanger 19 to a factory exhaust section. Alternatively, gas in the heating furnace 8 may be circularly used, without being exhausted to the factory exhaust section.

Figure 2:
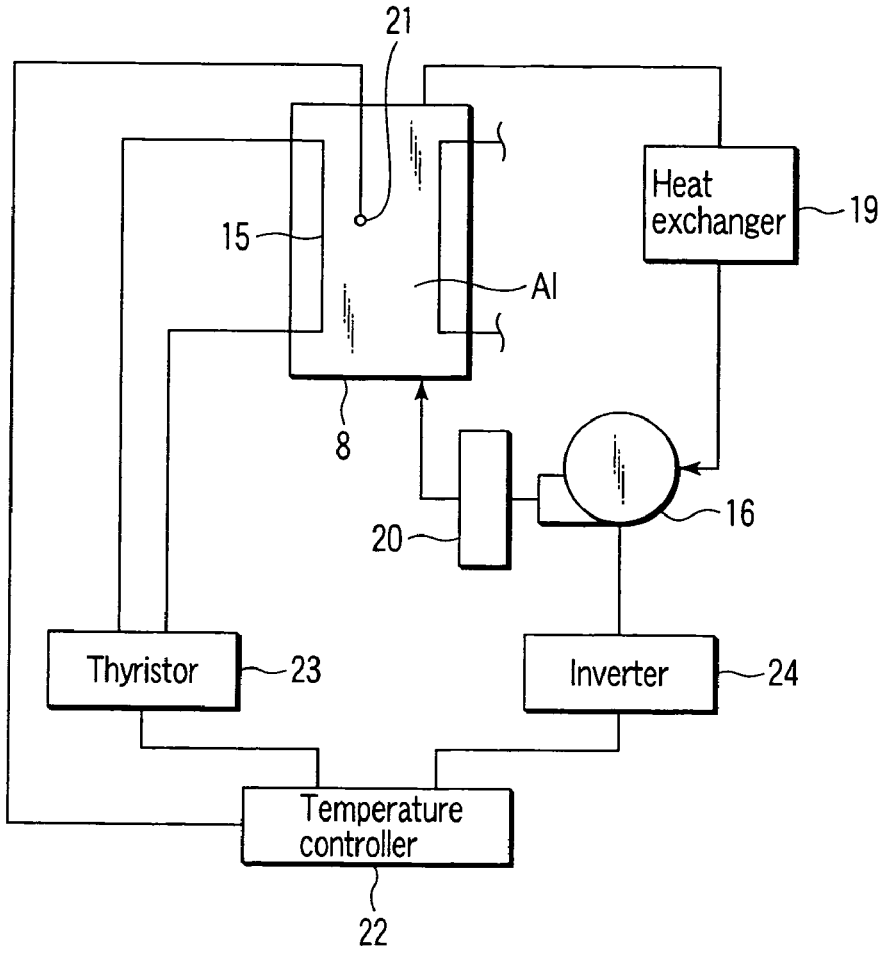
FIG. 2 is a block diagram schematically showing the temperature control system of the apparatus shown in FIG. 1 where gas is circularly used.

FIG. 2 is a block diagram schematically showing the temperature control system of the apparatus shown in FIG. 1 where gas is circularly used. As shown in FIG. 2, gas from the heating furnace 8 performs heat-exchange at the heat exchanger 19, and then returned to the suction side of the blower 16, thereby being circularly used. In this case, gas is preferably circulated through an air filter 20. The air filter 20 is preferably disposed on the delivery side of the blower 16, but it may be disposed only on the suction side of the blower 16. The heat exchanger 19 is disposed to utilize waste heat of the heating furnace 8.

A temperature sensor 21 is disposed in the process field A1 within the process chamber 5, to detect the process temperature. The detection signal or detection data obtained by the temperature sensor 21 is fed back to a temperature controller 22. The temperature controller 22 contains a program (sequence) for controlling the heater 15 and blower 16, so as to efficiently perform temperature increase recovery within a low temperature range, in accordance with a preset temperature (target temperature). The electric heater 15 is controlled by a power controller, such as a thyristor 23, in accordance with signals from the temperature controller 22. The electric blower 16 is controlled by a power controller, such as an inverter 24, in accordance with signals from the temperature controller 22.

Next, temperature control of the process field A1 within the process chamber 5 will be assumed such that the temperature thereof is changed from an initial temperature to a target temperature higher than the initial temperature but within a low temperature range (a range of 100 to 500° C.). In this case, the temperature controller 22 controls the heater 15 and blower 16, based on detection data obtained by the temperature sensor 21, so as to converge the temperature of the process field A1 to a target temperature in a short time. With this arrangement, it is possible to shorten the convergence time in attaining a target temperature in temperature increase recovery within a low temperature range, and to improve the controllability thereof.

In order to achieve this, more specifically, the temperature controller 22 may perform the following steps. At first, the power feeding to the heater 15 is set at a first supply rate or more to heat the process field A1 to a predetermined temperature immediately below a target temperature. Then, at a time point when it reaches this predetermined temperature, the power feeding to the heater 15 is decreased to a rate lower than the first supply rate. Then, while the power feeding to the heater 15 is set at a rate lower than the first supply rate, a cooling gas is supplied by the blower 16 to forcibly cool the process field A1. Then, the power feeding to the heater 15 is increased to maintain the process field A1 at the target temperature. At this time, the power feeding to the blower 16 is decreased, as needed.

In a first control method for realizing such temperature increase recovery within a low temperature range, the temperature controller 22 may keep the power feeding to the blower 16 constant from the step of heating the process field A1 to a predetermined temperature to the step of forcibly cooling the process field A1. In this case, the temperature controller 22 only performs adjustment to increase/decrease the power feeding to the heater 15.

Figure 3:
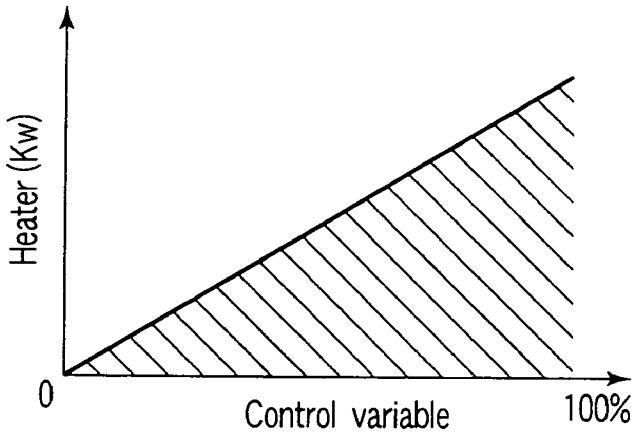
FIG. 3 is a view showing an example of control of a heater.

FIG. 3 is a view showing an example of control of the heater according to this first control method. In this case, the power feeding to the heater 15 is controlled in accordance with a control variable output from the temperature controller 22, independently of the power feeding to the blower 16.

Specifically, in order to perform temperature increase recovery within a low temperature range, while the blower 16 is maintained at a constant blowing rate (for example, 1 $m^3$/min), the power feeding to the heater 15 is performed until a time point immediately before a target temperature (until a time point when the process field A1 reaches a predetermined temperature immediately below the target temperature), and then the power feeding to the heater 15 is decreased to converge the temperature of the wafers W to the target temperature. The predetermined temperature is preferably preset to be 20 to 80° C. lower than the target temperature. Incidentally, when a rapid temperature decrease is required, the blower 16 can be set at a blowing rate of, e.g., 7 $m^3$/min.

In a second control method for realizing temperature increase recovery within a low temperature range, as described above, the temperature controller 22 may use a higher rate of the power feeding to the blower 16 in the step of forcibly cooling the process field A1 than in the step of heating the process field A1 to a predetermined temperature. In this case, the temperature controller 22 performs adjustment to increase/decrease the power feeding to the heater 15 and the power feeding to the blower 16.

Figure 4:
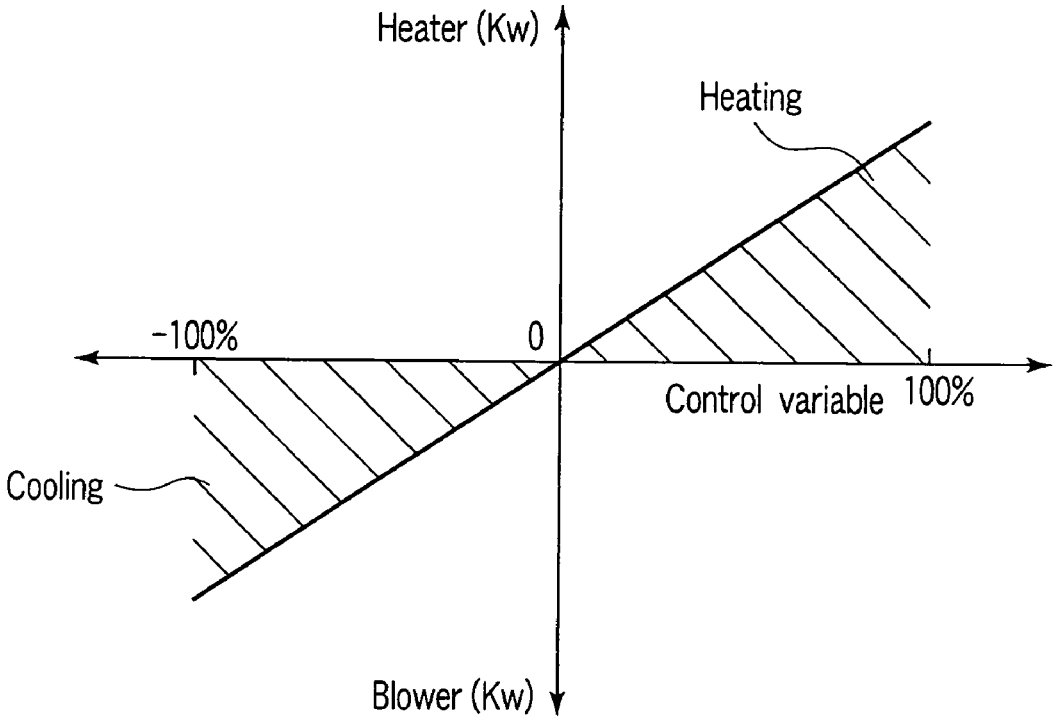
FIG. 4 is a view showing an example of control of a heater and a blower, using a common control variable.

FIG. 4 is a view showing an example of control of the heater and blower, using a common control variable, according to this second control method. In this case, the temperature controller 22 uses one control variable to control the power feeding to the heater 15 and the power feeding to the blower 16. This control variable is arranged to increase the power feeding to the heater 15 as the absolute value of the variable increases in the positive direction, and to increase the power feeding to the blower 16 as the absolute value of the variable increases in the negative direction.

Figure 5A:
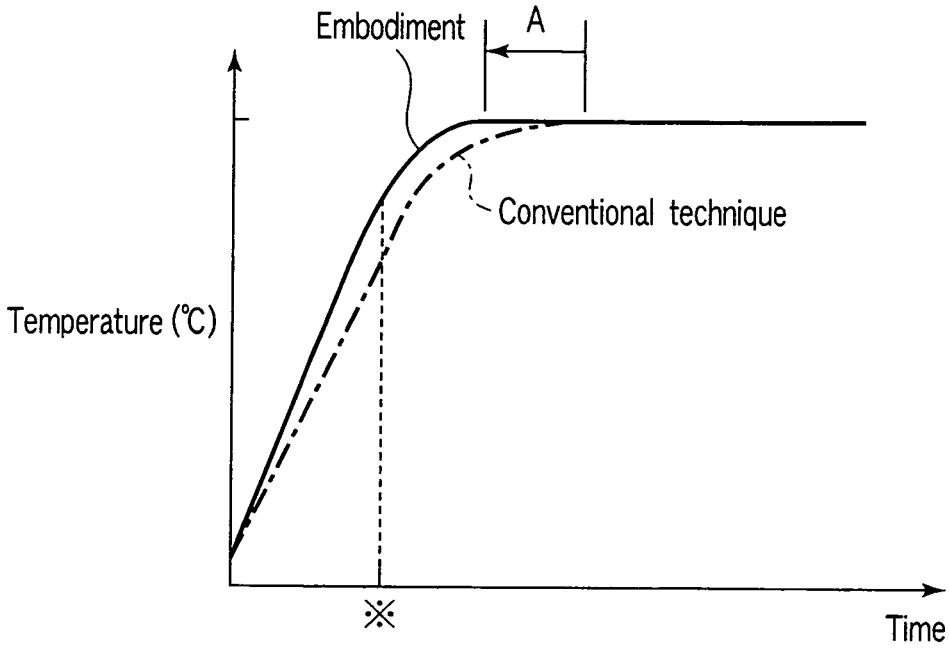
FIG. 5A is a view showing the time-temperature characteristic of an example of a control method for performing temperature increase recovery within a low temperature range.
Figure 5B:
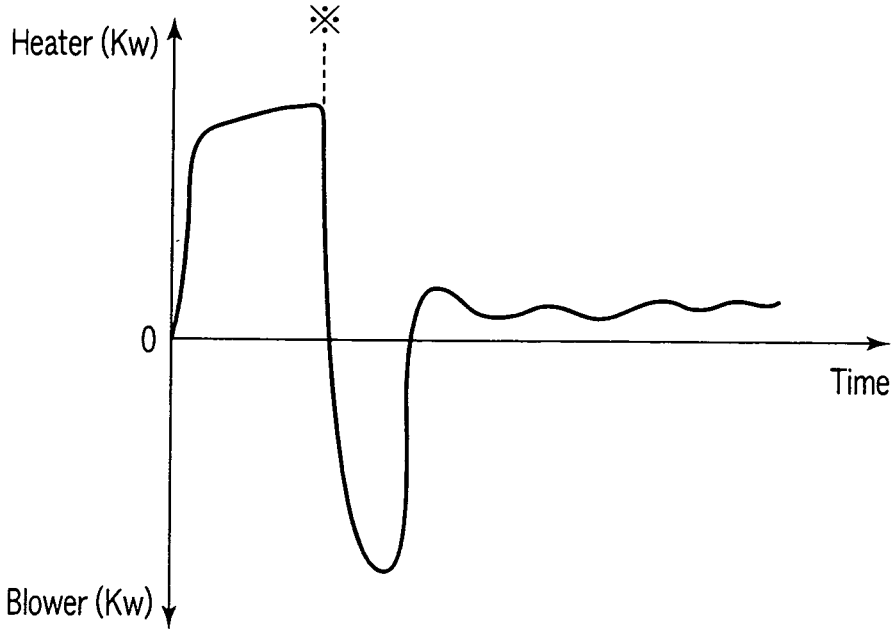
FIG. 5B is a view showing the time-power feeding characteristic of the example shown in FIG. 5A.

FIG. 5A is a view showing the time-temperature characteristic of an example of a control method for performing temperature increase recovery within a low temperature range. FIG. 5B is a view showing the time-power feeding characteristic of the example shown in FIG. 5A. As shown in FIGS. 5A and 5B, the power feeding to the heater 15 is performed until a time point immediately before a target temperature (until a time point when the process field A1 reaches a predetermined temperature immediately below the target temperature), and then the power feeding to the heater 15 is decreased and the power feeding to the blower 16 is increased to forcibly cool the process chamber 5, so as to converge the temperature of the wafers W to the target temperature. Also in this case, the predetermined temperature is preferably preset to be 20 to 80° C. lower than the target temperature.

According to the example shown in FIGS. 5A and 5B, the power feeding to the heater 15 is performed while the power feeding to the blower 16 is set at 0 (stopped) in the step of heating the process field A1 to a predetermined temperature immediately below a preset temperature (target temperature). At a time point when the process field A1 reaches the predetermined temperature, the power feeding to the heater 15 is set at 0 (stopped) and the power feeding to the blower 16 is started to forcibly air-cool the interior of the heating furnace 8 and the process chamber 5, so as to put a brake on the temperature increase. Then, at a time point when the temperature comes very close to (above or below) the target temperature, the power feeding to the blower 16 is set at 0 (stopped) and the power feeding to the heater 15 is restarted, so as to maintain the process field A1 at the target temperature.

As described above, the vertical heat processing apparatus 1 according to this embodiment can shorten the convergence time in temperature increase recovery within a low temperature range, and thus can shorten the TAT and improve the throughput. Further, since the body portion 5*b* of the process chamber 5 has a wall thickness smaller than that of the other portions, the process chamber 5 has a decreased thermal capacity while maintaining the size of the process chamber 5, which allows the convergence time to be much shorter. Furthermore, since the body portion 5*b* of the process chamber 5 has a smaller wall thickness, the temperature decrease performance can be improved due to natural cooling and forcible air-cooling, which is also effective to improve the TAT and throughput.

As described above, the first and second control methods for realizing temperature increase recovery within a low temperature range can shorten the convergence time in the temperature increase recovery within a low temperature range, and thus can shorten the TAT and improve the throughput. Particularly, according to the second control method for realizing temperature increase recovery within a low temperature range, the temperature controller 22 uses a higher rate of the power feeding to the blower 16 in the step of forcibly cooling the process field A1 than in the step of heating the process field A1 to a predetermined temperature. This arrangement can further improve controllability of the temperature increase recovery, as compared to the first control method. Consequently, as show in FIG. 5A, the second control method can further shorten the convergence time in temperature increase recovery within a low temperature range, and thus can shorten the TAT and improve the throughput.

<Experiment for First Control Method>

Experiments were conducted using the first control method described above for realizing temperature increase recovery within a low temperature range. In an experiment 1, the temperature of the process field A1 was changed from room temperature (about 25° C.) to 150° C. at a heat-up rate of 30° C./min. As a present example 1 according to the first control method, conditions were arranged to employ a thin wall tube with t=4 mm and to set the forcible air-cooling in the ON-state with a blowing rate of 1 $m^3$/min. As a comparative example 1, conditions were arranged to employ a conventional tube with t=6 mm and to set the forcible air-cooling in the OFF-state, with the other conditions being the same as those of the present example 1. As a result, the present example 1 shortened the convergence time by 20% (5.5 minutes), as compared to the comparative example 1.

In an experiment 2, the temperature of the process field A1 was changed from 200° C. to 400° C. at a heat-up rate of 30° C./min. As a present example 2 according to the first control method, conditions were arranged to employ a thin wall tube with t=4 mm and to set the forcible air-cooling in the ON-state with a blowing rate of 1 $m^3$/min. As a comparative example 2, conditions were arranged to employ a conventional tube with t=6 mm and to set the forcible air-cooling in the OFF-state, with the other conditions being the same as those of the present example 2. As a result, the present example 2 shortened the convergence time by 23.6% (1.5 minutes), as compared to the comparative example 2.

INDUSTRIAL APPLICABILITY

According to the present invention, there is provided a vertical heat processing apparatus and a control method for the same, which can shorten the convergence time in attaining a target temperature in temperature increase recovery within a low temperature range, and thus can shorten the TAT and improve the throughput.

The invention claimed is:

1. A vertical heat processing apparatus comprising:

a process chamber defining a process field configured to accommodate a plurality of target substrates supported at intervals in a vertical direction;

a heating furnace surrounding the process chamber, and including an electric heater configured to heat the process field from outside the process chamber;

an electric blower configured to send a cooling gas into the heating furnace, so as to cool the process field by the cooling gas from outside the process chamber;

a temperature sensor configured to detect a temperature inside the process field; and a control section configured to control the heater and the blower in accordance with detection data obtained by the temperature sensor, wherein, in order to conduct temperature control to change a temperature of the process field from an initial temperature to a target temperature higher than the initial temperature but within a range of 100 to 500° C., the control section executes, setting power feeding to the blower at a first feed rate to send the cooling gas, and setting power feeding to the heater at a first supply rate, in order to heat up the process field to a predetermined temperature below the target temperature, at a time point when the process field reaches the predetermined temperature, maintaining the power feeding to the blower at the first feed rate, and decreasing the power feeding to the heater to a second supply rate lower than the first supply rate, in order to converge the process field to the target temperature, and then, decreasing the power feeding to the blower to a rate lower than the first feed rate, and increasing the power feeding to the heater to a rate higher than the second supply rate, in order to maintain the process field at the target temperature.

2. A vertical heat processing apparatus comprising:

a process chamber defining a process field configured to accommodate a plurality of target substrates supported at intervals in a vertical direction;

a heating furnace surrounding the process chamber, and including an electric heater configured to heat the process field from outside the process chamber;

an electric blower configured to send a cooling gas into the heating furnace, so as to cool the process field by the cooling gas from outside the process chamber;

a temperature sensor configured to detect a temperature inside the process field; and a control section configured to control the heater and the blower in accordance with detection data obtained by the temperature sensor, wherein, in order to conduct temperature control to change a temperature of the process field from an initial temperature to a target temperature higher than the initial temperature but within a range of 100 to 500 ° C., the control section executes, preparing one control variable to control power feeding to the heater and power feeding to the blower, such that the control variable is arranged to increase the power feeding to the heater as an absolute value of the control variable increases in a positive direction, and to increase the power feeding to the blower as an absolute value of the control variable increases in a negative direction, stopping the power feeding to the blower, and setting the power feeding to the heater at a first supply rate, in accordance with the control variable, in order to heat up the process field to a predetermined temperature below the target temperature, at a time point when the process field reaches the predetermined temperature, setting the power feeding to the blower at the first feed rate to send the cooling gas, and stopping the power feeding to the heater, in accordance with the control variable, in order to converge the process field to the target temperature, and then, stopping the power feeding to the blower, and setting the power feeding to the heater to a rate lower than the first supply rate, in accordance with the control variable, in order to maintain the process field at the target temperature.

3. The apparatus according to claim 1, wherein the predetermined temperature is preset to be 20 to 80° C. lower than the target temperature.

4. The apparatus according to claim 1, wherein the process chamber comprises a quartz body portion corresponding to the process field, and a quartz upper portion and a quartz lower portion present above and below the body portion, respectively, and the body portion has a wall thickness smaller than those of the upper portion and the lower portion.

5. The apparatus according to claim 4, wherein the body portion differs from the upper portion and the lower portion in wall thickness by 4 mm or less.

6. A method of controlling a vertical heat processing apparatus, the apparatus comprising a process chamber defining a process field configured to accommodate a plurality of target substrates supported at intervals in a vertical direction, a heating furnace surrounding the process chamber, and including an electric heater configured to heat the process field from outside the process chamber, and an electric blower configured to send a cooling gas into the heating furnace, so as to cool the process field by the cooling gas from outside the process chamber, and wherein, in order to conduct temperature control to change a temperature of the process field from an initial temperature to a target temperature higher than the initial temperature but within a range of 100 to 500° C., the method comprises:

setting power feeding to the blower at a first feed rate to send the cooling gas, and setting power feeding to the heater at a first supply rate, in order to heat up the process field to a predetermined temperature below the target temperature;

at a time point when the process field reaches the predetermined temperature, maintaining the power feeding to the blower at the first feed rate, and decreasing the power feeding to the heater to a second supply rate lower than the first supply rate, in order to converge the process field to the target temperature; and then, decreasing the power feeding to the blower to a rate lower than the first feed rate, and increasing the power feeding to the heater to a rate higher than the second supply rate, in order to maintain the process field at the target temperature.

7. A method of controlling a vertical heat processing apparatus, the apparatus comprising a process chamber defining a process field configured to accommodate a plurality of target substrates supported at intervals in a vertical direction, a heating furnace surrounding the process chamber, and including an electric heater configured to heat the process field from outside the process chamber, and an electric blower configured to send a cooling gas into the heating furnace, so as to cool the process field by the cooling gas from outside the process chamber, and wherein, in order to conduct temperature control to change a temperature of the process field from an initial temperature to a target temperature higher than the initial temperature but within a range of 100 to 500° C., the method comprises:

preparing one control variable to control power feeding to the heater and power feeding to the blower, such that the control variable is arranged to increase the power feeding to the heater as an absolute value of the control variable increases in a positive direction, and to increase the power feeding to the blower as an absolute value of the control variable increases in a negative direction, stopping the power feeding to the blower, and setting the power feeding to the heater at a first supply rate, in accordance with the control variable, in order to heat up the process field to a predetermined temperature below the target temperature, at a time point when the process field reaches the predetermined temperature, setting the power feeding to the blower at the first feed rate to send the cooling gas, and stopping the power feeding to the heater, in accordance with the control variable, in order to converge the process field to the target temperature, and then, stopping the power feeding to the blower, and setting the power feeding to the heater to a rate lower than the first supply rate, in accordance with the control variable, in order to maintain the process field at the target temperature.

8. The method according to claim 6, wherein the predetermined temperature is preset to be 20 to 80° C. lower than the target temperature.

9. The apparatus according to claim 2, wherein the predetermined temperature is preset to be 20 to 80° C. lower than the target temperature.

10. The apparatus according to claim 2, wherein the process chamber comprises a quartz body portion corresponding to the process field, and a quartz upper portion and a quartz lower portion present above and below the body portion, respectively, and the body portion has a wall thickness smaller than those of the upper portion and the lower portion.

11. The apparatus according to claim 10, wherein the body portion differs from the upper portion and the lower portion in wall thickness by 4 mm or less.

12. The method according to claim 7, wherein the predetermined temperature is preset to be 20 to 80° C. lower than the target temperature.

* * * * *